US005738734A

United States Patent [19]

Sawa et al.

[11] Patent Number: 5,738,734

[45] Date of Patent: Apr. 14, 1998

[54] CENTRIFUGAL CAST ROLL SHELL MATERIAL

[75] Inventors: Yoshitaka Sawa, Chiba; Tomoya Koseki; Kenji Ichino, both of Handa, all of Japan

[73] Assignee: Kawasaki Steel Corporation, Kobe, Japan

[21] Appl. No.: 737,070

[22] PCT Filed: Mar. 6, 1996

[86] PCT No.: PCT/JP96/00544

§ 371 Date: Oct. 29, 1996

§ 102(e) Date: Oct. 29, 1996

[87] PCT Pub. No.: WO96/27688

PCT Pub. Date: Sep. 12, 1996

[30] Foreign Application Priority Data

Mar. 7, 1995 [JP] Japan ..... 7-072513
Feb. 6, 1996 [JP] Japan ..... 8-042162

[51] Int. Cl.[6] ..... C22C 37/06; C22C 38/36

[52] U.S. Cl. ..... 148/324; 420/15

[58] Field of Search ..... 148/324; 420/15

[56] References Cited

U.S. PATENT DOCUMENTS 3,929,471 12/1975 Akahori et al. .
5,225,007 7/1993 Hattori et al. ..... 148/325
5,316,596 5/1994 Kataoka ..... 420/15

FOREIGN PATENT DOCUMENTS 63-266041 11/1988 Japan .
4-365836 12/1992 Japan .
6-256888 9/1994 Japan .
6-335712 12/1994 Japan .

*Primary Examiner*—Deborah Yee
*Attorney, Agent, or Firm*—Oliff & Berridge, PLC

[57] ABSTRACT

A centrifugal cast roll shell material composed of a granular MC carbide, graphite and C: 2.5 to 4.7%, Si: 0.8 to 3.2%, Mn: 0.1 to 2.0%, Cr: 0.4 to 1.9%, Mo: 0.6 to 5%, V: 3.0 to 10.0% and Nb: 0.6 to 7.0%, satisfying the following formulae (1), (2), (3) and (4):

$$2.0+0.715\,V+0.10\,Nb \leqq C\ (\%) \quad (1)$$

$$1.1 \leqq Mo/Cr \quad (2)$$

$$Nb/V \leqq 0.8 \quad (3)$$

$$0.2 \leqq Nb/V \quad (4),$$

the remainder being Fe and inevitable impurities, wherein the pouring temperature is 1,400° C. or higher.

4 Claims, 2 Drawing Sheets

CENTRIFUGAL CAST ROLL SHELL MATERIAL

FIELD OF THE INVENTION

The present invention relates to a roll shell material which has excellent wear resistance, crack resistance and a small friction coefficient and is free from segregation even if centrifugally cast and also exhibits satisfactory resistance against cobble cracks and surface deterioration resistance.

BACKGROUND OF THE INVENTION

Hitherto, high chrome cast iron, nickel alloyed grain cast iron, adamite and so forth have been employed as the material for rolls in a rolling mill. Subsequently, a high-speed steel roll material and rolls comprising the same have been developed in order to improve the wear resistance.

For example, a roll shell material has been disclosed in Japanese Unexamined Patent Publication (JP-A) No. 4-365836, which contains C: 1.5 to 3.5%, Si: 1.5 % or less, Mn: 1.2% or less, Cr: 5.5 to 12.0%, Mo: 2.0 to 8.0%, V: 3.0 % to 10.0% and Nb: 0.6 to 7.0%, which satisfies the following formulas (1) and (2):

$$V+1.8Nb \leqq 7.5\ C-6.0\ (\%) \quad (1)$$

$$0.2 \leqq Nb/V \leqq 0.8 \quad (2)$$

and which further contains remainder of Fe and inevitable impurities, the roll shell material being free from segregation of composition and structure of the outer shell of the roll even if the roll is centrifugally cast and exhibiting wear resistance and crack resistance.

Japanese Unexamined Patent Publication (JP-A) No. 6-256888 discloses a high-speed cast steel material containing graphite and further composed of C: 1.8 to 3.6%, Si: 1.0 to 3.5%, Mn: 0.1 to 2.0%, Cr: 2.0 to 10.0%, Mo: 0.1 to 10.0 %, W: 0.1 to 10%, one or both of V and Nb: 1.5 to 10 % and the remainder which is substantially composed of Fe. This high-speed east steel material has a small friction coefficient and is capable of preventing propagation of cracks therein.

Japanese Unexamined Patent Publication (JP-A) No. 6-335712 discloses a wear and scoring resisting roll for a hot rolling mill which is composed of C: 2.0 to 4.0%, Si: 0.5 to 4.0%, Mn: 0.1 to 1.5%, Ni: 2.0 to 6.0%, Cr: 1.0 to 7.0%, V: 2.0 to 8.0%, and further contains one or more of Mo: 0.3 to 4.0%, W: 0.3 to 4.0%, Co: 1.0 to 10.0%, Nb: 1.0 to 10.0%, Ti: 0.01 to 2.0%, B: 0.02 to 0.2% and Cu: 0.02 to 1.0%.

A hot rolled product is manufactured by heating, in a heating furnace, a slab manufactured by continuous casting or blooming and having a thickness of 130 to 300 mm or by receiving the hot slab as it is, followed by hot-rolling the slab in a toughening rolling mill and a finishing rolling mill to form the slab into a strip having a thickness of 1.0 to 25.4 mm, followed by winding the strip into a coil by a winding machine (a coiler) and cooling the coil, and followed by subjecting it to processes by a variety of refining lines.

The finishing rolling mill is usually in the form of a continuous rolling mill having five to seven 4-high rolling mills arranged in series. Although 6-stand mills have been employed in the 30's of the Showa era, the majority of mills has employed seven stands in the 40's of the Showa era to improve the productivity and to be adaptable to a trend of enlarging the size of the coil. The finish rolling process sometimes encounters a so-called accident in drawing such that two plates are stacked for some reason between the stands and the stacked plates are unintentionally rolled. In particular, the probability of an accident of the foregoing type is increased in the backward stands. In a 7-stand finish rolling mill, an accident of the foregoing type takes place at the fifth and following stands. If the cobble accident happens, the temperature of the surface of the roll is locally raised owning to heat generated attributable to the friction caused from the abnormal rolling operation and that attributable to the rolling operation. When the roll is cooled with water, thermal impact sometimes generates cracks on the surface of the roll. The cobble cracks occur as described above. In general, if cobble accident happens, the roll is changed to investigate whether a crack of the roll has occurred due to the accident. If a crack is detected, the roll is ground until the crack is removed, thus resulting in an increase in the cost of the roll. If the existence of a crack is overlooked and the roll is again used, the cobble crack serves as a start from which the crack propagates, thus increasing a risk of a roll spalling accident. In this case, the line must be stopped for several to tens of hours, thus causing a great loss to be inflicted.

Hitherto, a centrifugally-cast high-alloy grain roll has generally been employed as a finishing roll utilized in the backward stand. Although the centrifugally-cast high-alloy grain roll exhibits a relatively low possibility of crack generation when encountering a cobble accident and, even if a crack is generated the generated crack is relatively shallow, it is characterized by poor wear resistance. Recently, a high-speed steel roll has been employed in the backward stand of the finishing rolling mill. Although a roll of the foregoing type has excellent wear resistance, which is three to five times that of the centrifugally-cast high-alloy grain roll, it suffers from a high probability of generation of drawing when encountering a cobble accident, and a deep crack if generated.

With respect to thin steel sheets used in forming the body of an automobile, the desired surface quality of a diversely shaped automobile is provided by obtaining a satisfactory surface quality of the product during the hot rolling process. Also the foregoing may be utilized in forming thin steel sheets for making electric products.

A problem sometimes arises due to a large friction coefficient between the rolls and the product which causes sheet passing characteristic to deteriorate and scoring to take place. As a result, the surface properties sometimes deteriorate. The foregoing problem has been solved by an invention filed in Japanese Unexamined Patent Publication (JP-A) No. 6-256888. However, problems with surface properties, such that scales on the roll or the material to be rolled, which are generated when the material is rolled, cause a scratch mark to be formed on the surface of the product by allowing the scale is to adhere just as if a wedge is inserted into the product that generates so called acicular scale marks, have not been solved by the prior art including Japanese Unexamined Patent Publication (JP-A) No. 4-365836 and Japanese Unexamined Patent Publication (JP-A) No. 6-256888.

In Japanese Unexamined Patent Publication (JP-A) No. 6-335712, a wear and scoring resisting roll for a hot rolling mill having a metal structure composed of graphite, MC carbides and cementite is disclosed. However, the MC carbides are unintentionally segregated attributable to centrifugal separation when the centrifugal casting operation is performed, thus causing a risk to arise in that the uniformity of the characteristics of the roll deteriorates. What is worse, no contrivance is employed to prevent acicular scale marks.

DISCLOSURE OF THE INVENTION

In view of the foregoing, an object of the present invention is to realize crack resistance and a low friction coefficient, to be free from segregation and to maintain resistance against surface roughening even if centrifugally cast while maintaining wear resistance, providing the characteristics of high-speed steel.

A centrifugal cast roll shell material as defined in claim 1 is composed of a granular MC type carbide, graphite, C: 2.5 to 4.7%, Si: 0.8 to 3.2%, Mn: 0.1 to 2.0%, Cr: 0.4 to 1.9%, Mo: 0.6 to 5%, V: 3.0 to 10.0% and Nb: 0.6 to 7.0%, satisfying the following formulae (1), (2), (3) and (4):

$$2.0+0.15\ V+0.10\ Nb \leqq C\ (\%) \quad (1)$$

$$1.1 \leqq Mo/Cr \quad (2)$$

$$N \leqq 0.8 \quad (3)$$

$$0.2 \leqq Nb/V \quad (4),$$

the remainder being Fe and inevitable impurities, wherein the pouring temperature is 1,400° C. or higher.

A centrifugal cast roll shell material as defined in claim 2 is composed of a granular MC type carbide, graphite and C: 2.5 to 4.7%, Si: 0.8 to 3.2%, Mn: 0.1 to 2.0%, Cr: 0.4 to 1.9%, Mo: 0.6 to 5%, V: 3.0 to 10.0%, Nb: 0.6 to 7.0% and B: 0.002 to 0.1%, satisfying the following formulae (1), (2), (3) and (4):

$$2.0+0.15\ V+0.10\ Nb \leqq C\ (\%) \quad (1)$$

$$1.1 \leqq Mo/Cr \quad (2)$$

$$Nb/V \leqq 0.8 \quad (3)$$

$$0.2 \leqq Nb/V \quad (4),$$

the remainder being Fe and inevitable impurities, wherein the pouring temperature is 1,400° C. or higher.

A centrifugal cast roll shell material as defined in claim 3 having a structure according to claim 1 and 2 further containing Ni: 5.5% or less.

(A) The Centrifugal Cast Roll Shell Material Defined in claim 1

"Having Granular MC type Carbide"

Existence of hard MC type carbide is most effective in improving wear resistance. By granulating the shape of the carbide, which allows the carbide to be uniformly dispersed into the structure of the roll material, the uniformity and crack resistance of the roll can be improved.

"Making pouring Temperature to be 1,400° C. or Higher"

As MC type carbide is effective in improving wear resistance, WC and VC have been known and employed. This embodiment is characterized in that Nb and V are compositely added in order to maintain granular MC type carbide when the centrifugal casting operation is performed. That is, a {V,Nb} C composite carbide having NbC as the core thereof is crystallized in a molten material, and then coagulation accompanying crystallization of eutectic structure and graphite proceeds so that the manufacture is completed. Nb acts as the core of the MC type carbide, which is crystallized in the molten material. Although the VC carbide, having a small specific gravity, is centrifugally separated and segregated when the centrifugal separation is performed, it is formed into {V,Nb} C composite carbide, having a large specific gravity, when mixed with Nb so that it cannot easily be centrifugally separated. However, if the pouring temperature is too low, crystallized carbide ({V, Nb}C) in the molten material is allowed to grow and become coarsened, thus resulting in the carbide ({V,Nb}C) being centrifugally separated. Therefore, the temperature must be 1,400° C. or higher. It is preferable that the temperature be in a range from 1,450° C. to 1,520° C.

"Having Graphite"

The quantity of graphite to be crystallized is mainly dependent upon quantities of C used, which is the source of the graphite, Si having the effect of crystallizing graphite, and V and Nb for consuming C before the graphite is crystallized. In the present invention, the quantity of C is determined to be 0.2 to 5% as the area ratio in the scope of the present invention. Graphite absorbs stress which is generated when a thermal shock takes place. Graphite serves as a solid lubricant which reduces the friction coefficient and improves the scoring resistance.

C: 2.5 to 4.7%

C is an essential element for forming hard carbide and for improving the wear resistance of the roll shell material, which is crystallized as the graphite in the base structure. The quantity of C is required to be 2.5% or more. Since the wear resistance deteriorates if the quantity is larger than 4.7%, the upper limit is set at 4.7%. More preferably, the quantity is 2.9% to 4.0%.

Si: 0.8 to 3.2%

Si is added for deoxidation, maintaining suitable casting characteristics and crystallizing the graphite. If the quantity is less than 0.8%, crystallization of the graphite is insufficient. If the quantity is larger than 3.2%, the quantity of the crystallized graphite is increased excessively, causing wear resistance to deteriorate. Therefore, the upper limit is set at 3.2%.

Mn: 0.1 to 2.0%

The quantity of Mn must be 0.1% or more because Mn is combined with S, which is mixed as an impurity to be formed into MnS so as to prevent brittleness attributable to S. If the quantity is larger than 2.0%, cracking resistance deteriorates. Therefore, the upper limit is set at 2.0%. More preferably, the quantity is 0.2% to 1.0%.

Cr: 0.4 to 1.9%

The quantity of Cr must be 0.4% or more in order to form the carbide, improve the wear resistance, strengthen the base structure and improve the crack resistance. Since Cr is a very strong degraphiting element, addition of amounts exceeding 1.9% prevents crystallization of the graphite during the solidification process. Therefore, the upper limit is set at 1.9%. More preferably, the quantity is 0.5% to 1.0%.

Mo: 0.6 to 5%

Mo affects the formation of carbide in a manner similar to Cr and effectively improve wear resistance and strengthen the base structure to improve crack resistance. Moreover, Mo is effective to improve the hardenability of the base structure and the softening resistance in tempering. Therefore, the quantity must be 0.6% or more. If the quantity is larger than 5%, the crack resistance deteriorates. Therefore, the upper limit is set at be 5%.

V: 3.0 to 10.0%

V is an essential element for forming a hard MC (or $M_4C_3$) type carbide and is most effective in improving wear resistance. The diameter of the carbide is about several μm. In order to provide this effect, the quantity must be 3.0% or more. If the quantity is larger than 10.0%, the deterioration of the crack resistance and manufacturing ploblems, such as defective melting, arise. Therefore, the upper limit is set at 10.0%.

$$Nb:\ 0.6\ to\ 7.0\%\ and\ 0.2 \leqq Nb/V \quad (4)$$

When VC carbide has a specific gravity that is smaller than that of the base molten material, it is segregated when centrifugally separated. Nb is added to prevent the segregation above. Nb forms a composite carbide {V,Nb} C together with V so as to raise the specific gravity, as compared with a case where the carbide solely contains V. As a result, segregation attributable to the centrifugal separation is prevented. Therefore, the quantity of Nb must be changed to correspond to the quantity of V added. To obtain a uniform shell by the centrifugal casting method shown in FIG. 1, the quantity must satisfy $0.2 \leqq Nb/V$. Since V is added by 3.0% or more, the minimum quantity of Nb must be 0.6% or more. If the quantity of Nb is larger than 7.0%, manufacturing problems, such as defective melting, arise. Therefore, the upper limit is 7.0%.

Referring to FIG. 1, "Wear Ratio (Inner Layer/Outer Layer)" is a ratio (Iw/Ow) of the amount of wear (Iw) of a specimen that is sampled at an inner layer of a ring material and the amount of wear (Ow) of a specimen that is sampled at an outer layer of the same. The experiment shown in FIG. 1 was performed by using a specimen obtained such that a ring sample, having a thickness of 100 mm and obtained by pouring at temperature of 1,470° C., C: 4.1%, Si: 1.1%, Mn: 0.3%, Cr: 0.9%, Mo: 2.0%, V: 5.1% and Nb: 0 to 7.5% and by centrifugally casting (140 G) the material, was normalized at 1,050° C. and tempered at 550° C. A wear resistance test was performed such that two discs, a test speciment sampled above having a size of $\phi 50 \times 10$ and a speciment that is "the other" having a size of $\phi 190 \times 15$,, were slipped and rubbed against each other to heat "the other" disc to 800° C. In a state where the two discs were pressed against each other with a load of 100 kgf, a test speciment is rotated at 800 rpm. Assuming that the slippage ratio was 3.9%, the amount of the weight loss owning to the abrasion after a lapse of 120 minutes was measured.

$$2.0+0.15\,V+0.10\,Nb \leqq C\ (\%) \quad (1)$$

When the roll material according to the present invention is solidified, the {V,Nb} C composite carbide and dendrite are initially crystallized, and then graphite and eutectic structure are crystallized so that the solidification is completed. Consumption of C is by V and Nb and is given priority, and the residue is graphite and so forth. Formula (1) expresses a condition for making the crystallized graphite to be 0.2% or more in terms of the area ratio.

$$1.1 \leqq Mo/Cr \quad (2)$$

The foregoing formula shows a conditional expression for preventing generation of the acicular scale marks. As a result of the experiment shown in Table 1, formula (2) indicates the range with which generation of the acicular scale marks can be prevented. The rolling test shown in Table 1 was performed such that molten metal composed of C: 4.0%, Si: 1.3%, Mn: 0.5%, Cr: 0.6, 1.0 and 1.7%, MO: 0.2 to 7.0%, V: 4.8% and Nb: 1.4% was poured into a sand mold at a temperature of 1,500° C., followed by forming a cylindrical block having a size of $\phi 90 \times 250$ mm, which was then normalized at 1,050° C. and tempered at 550° C. As a result, a roll having a diameter of 70 mm and a width of 40 mm was obtained. Then, three coils, each of which was made of SUS304 and which had a thickness of 1.2 mm, a width of 20 mm and a length of 600 m, were hot-rolled. The reduction ratio was 40%, the rolling speed was 100 mpm, and the rolling temperature was 1,050° C. The foregoing conditions correspond to an actual operation in which 315 slabs are rolled in the forward step (the first step) in the hot rolling finishing process. In this test, the coil, which is heated immediately before it was rolled, was descaled. After the experimented test, the surface condition of the rolled material was examined to determine whether there exist scratch marks and scale that is inserted into the product like a wedge.

$$Nb/V \leqq 0.8 \quad (3)$$

The foregoing formula is a conditional expression for maintaining suitable crack resistance. As a result of the experiment shown in FIG. 2, a fact was confirmed that formula (3) expresses a range with which crack resistance does not deteriorate. In the experiment shown in FIG. 2, a specimen obtained from the outer layer of the ring material employed in the experiment shown in FIG. 1 was employed. The thermal shock test was performed such that a plate-like specimen having a size of 55×40×15 mm was, for 15 seconds, pressed against a roller rotating at 1,200 rpm. Immediately after this, the specimen was cooled with water to generate cracks. The pressing load was 150 kgf. After the test, the specimen was cut, and then the length of any cracks was measured.

(B) Centrifugal Cast Roll Shell Material Defined in claim 2

B, defined in the amounts set forth as follows is added to the centrifugal east roll shell material defined in claim 1.

B: 0.002 to 0.1%

B is combined with dissolved N to be formed into BN, which serves as a core for crystallizing graphite. The existence of the graphite core aids that the crystallized graphite becomes fine and improves the wear resistance. Moreover, when the roll is worn when used in the rolling process, B causes the wear to take place more uniformly on the order of the grain size, which is about 10 to 100 μm. Therefore, the quality of surface of manufactured goods can be improved. To cause the foregoing effects to be obtained, the quantity of B must be 0.002% or more. If the quantity is larger than 0.1%, a problem of deterioration in the crack resistance occurs. Therefore, the upper limit is set at 0.1%. More preferably, the quantity is 0.04% to 0.1%.

(C) Centrifugal Cast Roll Shell Material Defined in claim 3

Ni, defined in the amount as follows, is added to the centrifugal cast roll shell material according to claim 1 or 2.

Ni: 5.5% or less

Ni is added to improve hardenability. If the diameter of the roll is small or the roll is a sleeve type roll that can be quenched with water or with oil, Ni is not always a required element. In other cases, it is preferable that Ni be added. In a case of a roll having a diameter of 1,500mm, which is the largest class for a roll used in a rolling mill, and natural cooling is utilized, in which the cooling rate is low, the quantity of Ni is 5.5% or lower in order to enable hardening. More preferably, the quantity is 2.5% to 5.0%.

BEST PRACTICAL MODES OF THE INVENTION

EXAMPLE 1

Figure 1:
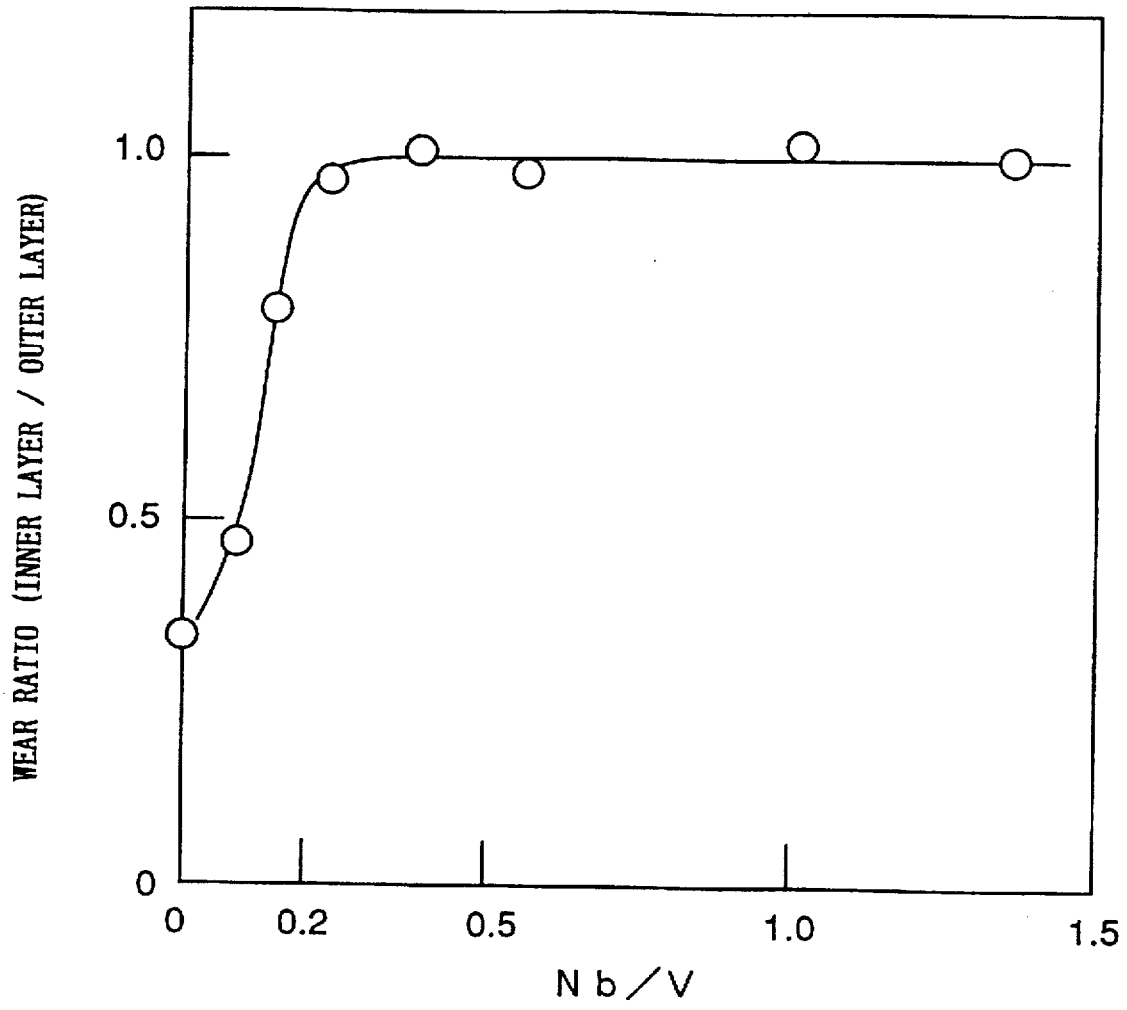
FIG. 1 is a graph showing the influences of added Nb/V, which is the content ratio of Nb and V that affects the carbide distribution, upon the hot wear ratio between the outer layer and the inner layer occurring in the centrifugally cast ring material.
Figure 2:
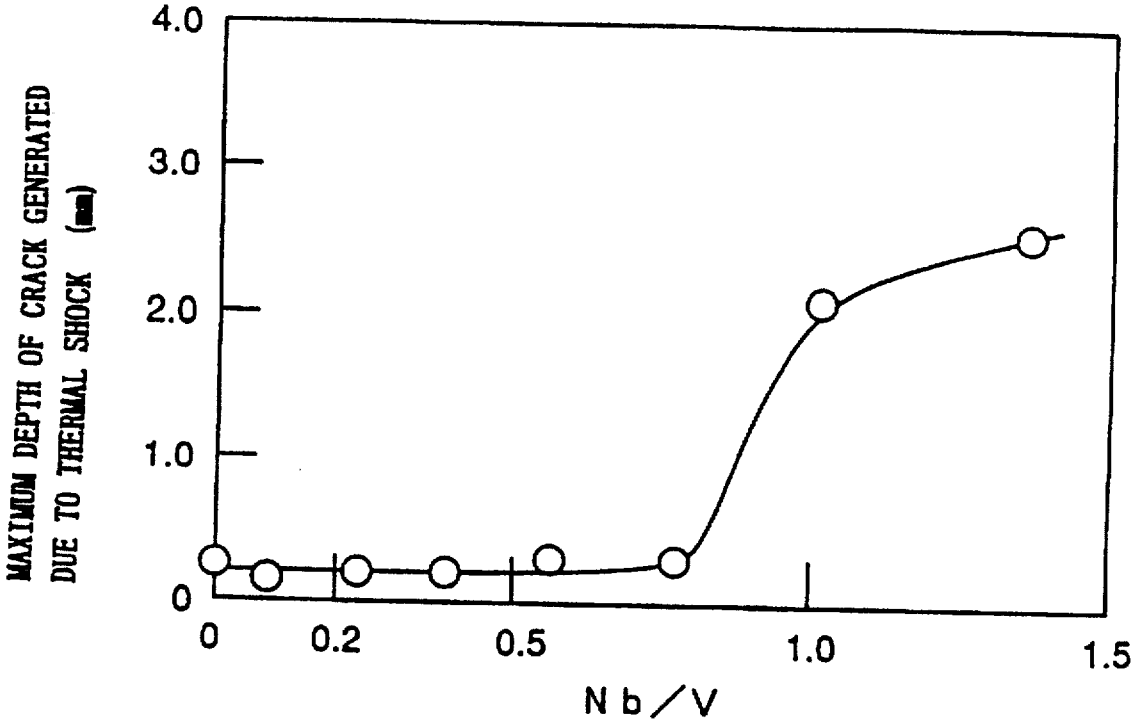
FIG. 2 is a graph showing the influence of Nb/V, which is the content ratio of Nb and V, upon the depths of cracks generated in the thermal shock test.

Molten irons (materials of examples of the present invention: A1 to A12 and materials of comparative examples: B1 to B13, respectively) having the chemical compositions shown in Table 2 were employed in a centrifugal casting method (140 G) in which the pouring temperature was 1,480° C. so that cast ting samples each having a thickness of 100 mm were manufactured. Then, the samples were normalized at 1,030° C. and tempered at 530° C., and subsequently Shore hardness, hot wear and thermal shock tests were performed.

Note that the wear test was performed such that a specimen having a size of ϕ50×10 mm was obtained from each of the inner layer and the outer layer of the ring material and the foregoing conditions were employed. The friction coefficient was obtained from the radius of the specimen, the load, and the torque acting on the specimen.

The thermal shock test was performed such that a plate-like specimen was obtained from the outer layer of the ring material and the above-mentioned conditions were employed.

The rolling test was performed by obtaining a specimen having a size of ϕ70×40 mm from the outer layer of the ring material and by employing the foregoing conditions.

Results of the wear test, thermal shock test and the rolling tests are shown in Table 3. As can be understood from Table 3, the materials (A1 to A12) according to the present invention, as compared with the comparative materials, simultaneously satisfied wear resistance, crack resistance, low friction coefficient, surface deterioration resistance and material uniformity after the centrifugal casting operation.

As for material B1, to which C was added in a small quantity, graphite was not crystallized. Therefore, the friction coefficient was raised. Material B2, to which C was added in a large quantity, encountered excessively large graphite crystallization. Thus, the wear resistance deteriorated. As for material B3, to which Si was added in a small quantity, no graphite was crystallized. Therefore, the friction coefficient was too high. Material B4, to which Si was added in a large quantity, encountered an excessively large quantity of graphite crystallization. As a result, the wear resistance deteriorated. Because material B4 did not satisfy formula (2), defects were detected on the surface of the product sheet during the rolling test. In Material B5, to which Mn was added in a large quantity, the crack resistance deteriorated. Since material B5 did not satisfy formula (2), defects were detected on the surface of the product sheet during the rolling test. Material B6, to which Cr was added in a small quantity, encountered deterioration in the wear resistance. Material B7, to which Cr was added in a large quantity, encountered degraphitization and no crystallization of graphite. As a result, the friction coefficient was too high. As for material B8 containing Mo in an excessively large quantity, it encountered deterioration in the crack resistance. Material B9, in which the quantity of V was too small, encountered deterioration in the wear resistance and some deterioration of the crack resistance. As for material B10, to which V was added excessively, it encountered deterioration in the crack resistance. Since material B11 did not satisfy formula (4), segregation of carbide resulted in the wear resistance of the outer layer being allowed to deteriorate. Since material B12 did not satisfy formula (2), defects were detected on the surface of the product plate during the rolling test. Since material B13 did not satisfy formula (3), its crack resistance deteriorated.

EXAMPLE 2

Molten irons (materials of examples of the present invention: C1 to C12 and materials of comparative examples: D1 to D13, respectively) having the chemical compositions shown in Table 4 were employed in a centrifugal casting method (140 G) in which the pouring temperature was 1,480° C. so that cast ring samples each having a thickness of 100ram were manufactured. Then, the samples were normalized at 1,030° C. and tempered at 530° C. and subsequently Shore hardness, hot wear and thermal shock tests were performed.

Note that the wear test was performed such that a specimen having a size of ϕ50×10 mm was obtained from each of the inner layer and the outer layer of the ring material and the foregoing conditions were employed. The friction coefficient was obtained from the radius of the specimen, the load, and the torque acting on the specimen.

The thermal shock test was performed such that a plate-like specimen was obtained from the outer layer of the ring material and the above-mentioned conditions were employed.

The rolling test was performed by obtaining a specimen having a size of ϕ70×40 mm from the outer layer of the ring material and by employing the foregoing conditions.

Results of the wear test, thermal shock test and the rolling tests are shown in Table 5. As can be understood from Table 5, the materials (C1 to C12) according to the present invention, as compared with the comparative materials, simultaneously satisfied wear resistance, crack resistance, low friction coefficient, surface deterioration resistance and material uniformity after the centrifugal casting operation.

As for material D1, to which C was added in a small quantity, graphite was not crystallized. Therefore, the friction coefficient was raised. Material D2, to which C was added in a large quantity, encountered excessively large graphite crystallization. Thus, the wear resistance deteriorated. As for material D3, to which Si was added in a small quantity, no graphite was crystallized. Therefore, the friction coefficient was too high. Material D4, to which Si was added in a large quantity, encountered an excessively large quantity of graphite crystallization. As a result, the wear resistance deteriorated. Because material D4 did not satisfy formula (2), defects were detected on the surface of the product sheet during the rolling test. In material D5, to which Mn was added in a large quantity, the crack resistance deteriorated. Since material D5 did not satisfy formula (2), defects were detected on the surface of the product plate during the rolling test. Material D6, to which Cr was added in a small quantity, encountered deterioration in the wear resistance. Material D7, to which Cr was added in a large quantity, encountered degraphitezation and no crystallization of graphite. As a result, the friction coefficient was too high. As for material D8 containing Mo in an excessively large quantity, it encountered deterioration in the crack resistance. Material D9, in which the quantity of V was too small, encountered deterioration in the wear resistance and some deterioration of the crack resistance. As for material D10, to which V was added excessively, it encountered deterioration in the crack resistance. Since material D11 did not satisfy formula (4), segregation of carbide resulted in the wear resistance of the outer layer being allowed to deteriorate. Since material D12 did not satisfy formula (2), defects were detected on the surface of the product sheet during the rolling test. Since material D13 did not satisfy formula (3), its crack resistance deteriorated. Since no B was added to material D14, its wear resistance is unsatisfactory as compared with material A. Since B was added in an excessively large quantity to material D15, its crack resistance deteriorated.

INDUSTRIAL USABILITY

As described above, according to the present invention, there is provided a centrifugal cast roll shell material having wear resistance, crack resistance and a low friction coefficient, capable of being free from segregation even if centrifugally cast, roll shell material also exhibiting surface deterioration resistance.

TABLE 1

| Cr | Mo | Mo/Cr | Surface Observation: Scratch Mark | Surface Observation: Introduction of Scale |
|---|---|---|---|---|
| 0.6 | 0.2 | 0.33 | detected | detected |
| 0.6 | 0.5 | 0.83 | detected | not detected |
| 0.6 | 0.8 | 1.33 | not detected | not detected |
| 0.6 | 1.3 | 2.17 | not detected | not detected |
| 0.6 | 3.5 | 5.83 | not detected | not detected |
| 0.6 | 4.6 | 7.67 | not detected | not detected |
| 0.6 | 6.8 | 11.33 | not detected | not detected |
| 1.0 | 0.2 | 0.20 | detected | detected. |
| 1.0 | 0.5 | 0.50 | detected | detected |
| 1.0 | 0.9 | 0.90 | detected | detected |
| 1.0 | 1.2 | 1.20 | not detected | not detected |
| 1.0 | 2.8 | 2.80 | not detected | not detected |
| 1.0 | 4.5 | 4.50 | not detected | not detected |
| 1.0 | 6.6 | 6.60 | not detected | not detected |
| 1.7 | 0.3 | 0.18 | detected | detected |
| 1.7 | 0.5 | 0.29 | detected | detected |
| 1.7 | 1.1 | 0.65 | detected | detected |
| 1.7 | 1.6 | 0.94 | detected | detected |
| 1.7 | 1.9 | 1.12 | not detected | not detected |
| 1.7 | 3.5 | 2.06 | not detected | not detected |
| 1.7 | 5.6 | 3.29 | not detected | not detected |

TABLE 2

| Material | No. | C | Si | Mn | P | S | Cr | Mo | V | Nb | Ni |
|---|---|---|---|---|---|---|---|---|---|---|---|
| Material According to Present Invention | A1 | 3.7 | 0.9 | 0.2 | 0.02 | 0.01 | 1.7 | 4.0 | 3.0 | 1.0 | — |
| | A2 | 2.9 | 2.8 | 0.6 | 0.03 | 0.01 | 0.6 | 0.7 | 4.2 | 2.0 | — |
| | A3 | 2.7 | 1.4 | 0.5 | 0.03 | 0.01 | 0.8 | 1.2 | 3.4 | 1.2 | — |
| | A4 | 3.5 | 1.1 | 0.3 | 0.02 | 0.01 | 1.6 | 1.8 | 7.0 | 3.1 | — |
| | A5 | 4.5 | 1.1 | 0.8 | 0.02 | 0.01 | 0.6 | 3.0 | 5.0 | 2.1 | — |
| | A6 | 4.1 | 2.0 | 1.0 | 0.03 | 0.01 | 1.5 | 2.0 | 4.8 | 1.6 | — |
| | A7 | 3.9 | 1.3 | 0.3 | 0.02 | 0.01 | 0.7 | 1.8 | 5.0 | 1.3 | — |
| | A8 | 3.9 | 1.3 | 0.3 | 0.02 | 0.01 | 0.8 | 2.0 | 3.8 | 2.9 | — |
| | A9 | 4.5 | 1.6 | 0.3 | 0.02 | 0.01 | 0.6 | 1.0 | 3.2 | 0.9 | — |
| | A10 | 3.2 | 1.2 | 1.8 | 0.03 | 0.01 | 0.8 | 1.2 | 5.2 | 4.0 | — |
| | A11 | 2.8 | 1.2 | 0.4 | 0.03 | 0.01 | 0.9 | 2.5 | 3.7 | 1.3 | 1.5 |
| | A12 | 3.2 | 1.5 | 0.3 | 0.03 | 0.01 | 0.8 | 2.1 | 4.6 | 2.0 | 4.8 |
| Material According to Comparative Examples | B1 | 2.4 | 1.2 | 0.2 | 0.02 | 0.01 | 1.7 | 1.9 | 5.1 | 1.8 | — |
| | B2 | 4.8 | 1.0 | 0.3 | 0.03 | 0.01 | 0.7 | 2.1 | 3.8 | 2.7 | — |
| | B3 | 3.9 | 0.4 | 0.3 | 0.03 | 0.01 | 0.8 | 2.5 | 6.0 | 1.3 | — |
| | B4 | 3.2 | 3.5 | 0.4 | 0.03 | 0.01 | 1.7 | 0.8 | 5.0 | 1.5 | — |
| | B5 | 4.0 | 1.1 | 2.3 | 0.03 | 0.01 | 0.8 | 0.7 | 4.6 | 2.1 | — |
| | B6 | 3.9 | 1.0 | 0.4 | 0.02 | 0.01 | 0.1 | 1.8 | 5.2 | 1.2 | — |
| | B7 | 3.8 | 1.6 | 0.3 | 0.02 | 0.01 | 2.1 | 2.5 | 5.1 | 3.0 | — |
| | B8 | 4.2 | 1.0 | 0.3 | 0.03 | 0.01 | 1.5 | 6.1 | 4.2 | 1.2 | — |
| | B9 | 3.9 | 0.9 | 0.5 | 0.03 | 0.01 | 0.6 | 1.5 | 2.6 | 1.2 | — |
| | B10 | 4.3 | 1.3 | 0.4 | 0.02 | 0.01 | 0.7 | 1.3 | 10.7 | 3.0 | — |
| | B11 | 3.6 | 1.1 | 0.3 | 0.03 | 0.01 | 0.8 | 0.9 | 3.4 | 0.6 | — |
| | B12 | 3.7 | 1.2 | 0.3 | 0.03 | 0.01 | 1.6 | 1.2 | 5.1 | 1.6 | — |
| | B13 | 3.8 | 1.5 | 0.8 | 0.03 | 0.01 | 0.7 | 1.6 | 5.5 | 5.0 | — |

TABLE 3

| No. | 2.0 + 0.15 V + 0.10 Nb—C (%) | Mo/Cr | Nb/V | Wear Resistance Test: Hardness Hs | Wear Resistance Test: Area Ratio of Graphite (%) | Wear Resistance Test: Amount of Wear (g) Outer Layer | Wear Resistance Test: Amount of Wear (g) Inner Layer | Wear Resistance Test: Friction Coefficient (–) | Rolling Test: Surface Observation: Scratch Mark | Rolling Test: Surface Observation: Introduction of Scale | Thermal Shock Test: Maximum Depth of Crack Due to Thermal Shock (mm) |
|---|---|---|---|---|---|---|---|---|---|---|---|
| A1 | –1.15 | 2.35 | 0.33 | 80 | 1.7 | 0.17 | 0.18 | 0.264 | Not Detected | Not Detected | 0.2 |
| A2 | –0.07 | 1.17 | 0.48 | 81 | 0.7 | 0.18 | 0.16 | 0.272 | Not Detected | Not Detected | 0.3 |
| A3 | –0.07 | 1.50 | 0.35 | 79 | 0.4 | 0.18 | 0.19 | 0.271 | Not Detected | Not Detected | 0.4 |
| A4 | –0.14 | 1.13 | 0.44 | 81 | 0.3 | 0.20 | 0.19 | 0.268 | Not Detected | Not Detected | 0.2 |
| A5 | –1.54 | 5.00 | 0.42 | 82 | 2.6 | 0.16 | 0.17 | 0.269 | Not Detected | Not Detected | 0.1 |
| A6 | –1.22 | 1.33 | 0.33 | 80 | 2.1 | 0.18 | 0.19 | 0.270 | Not Detected | Not Detected | 0.3 |
| A7 | –1.02 | 2.57 | 0.26 | 79 | 1.8 | 0.18 | 0.17 | 0.267 | Not Detected | Not Detected | 0.1 |
| A8 | –1.04 | 2.50 | 0.76 | 80 | 1.8 | 0.19 | 0.17 | 0.266 | Not Detected | Not Detected | 0.1 |
| A9 | –1.93 | 1.67 | 0.28 | 81 | 3.2 | 0.16 | 0.15 | 0.271 | Not Detected | Not Detected | 0.2 |
| A10 | –0.02 | 1.50 | 0.77 | 80 | 0.3 | 0.17 | 0.15 | 0.268 | Not Detected | Not Detected | 0.1 |
| A11 | –0.12 | 2.78 | 0.35 | 80 | 0.4 | 0.17 | 0.16 | 0.270 | Not Detected | Not Detected | 0.1 |
| A12 | –0.31 | 2.63 | 0.43 | 82 | 0.7 | 0.17 | 0.15 | 0.268 | Not Detected | Not Detected | 0.2 |
| B1 | 0.55 | 1.12 | 0.35 | 81 | 0.0 | 0.17 | 0.16 | 0.380 | Not Detected | Not Detected | 0.2 |
| B2 | –1.96 | 3.00 | 0.71 | 82 | 5.6 | 1.23 | 1.45 | 0.270 | Not Detected | Not Detected | 0.5 |
| B3 | –0.87 | 3.13 | 0.22 | 80 | 0.0 | 0.17 | 0.18 | 0.365 | Not Detected | Not Detected | 0.3 |
| B4 | –0.30 | 0.47 | 0.30 | 80 | 8.0 | 1.56 | 1.50 | 0.268 | Detected | Detected | 0.4 |
| B5 | –1.10 | 0.88 | 0.46 | 81 | 1.9 | 0.18 | 0.19 | 0.273 | Detected | Detected | 2.8 |
| B6 | –1.00 | 18.00 | 0.23 | 80 | 1.8 | 0.89 | 0.90 | 0.268 | Not Detected | Not Detected | 3.2 |
| B7 | –0.74 | 1.19 | 0.59 | 83 | 0.0 | 0.18 | 0.20 | 0.399 | Not Detected | Not Detected | 0.6 |
| B8 | –1.45 | 4.07 | 0.29 | 80 | 2.2 | 0.18 | 0.18 | 0.273 | Not Detected | Not Detected | 3.3 |
| B9 | –1.39 | 2.50 | 0.46 | 79 | 2.3 | 1.03 | 1.11 | 0.268 | Not Detected | Not Detected | 0.7 |
| B10 | –0.40 | 1.86 | 0.28 | 80 | 0.9 | 0.17 | 0.16 | 0.273 | Not Detected | Not Detected | 1.9 |
| B11 | –1.03 | 1.13 | 0.18 | 81 | 1.7 | 1.50 | 0.13 | 0.273 | Not Detected | Not Detected | 0.3 |
| B12 | –0.78 | 0.75 | 0.31 | 81 | 1.2 | 0.18 | 0.18 | 0.269 | Detected | Detected | 0.2 |
| B13 | –0.48 | 2.29 | 0.91 | 80 | 1.0 | 0.19 | 0.17 | 0.275 | Not Detected | Not Detected | 2.3 |

TABLE 4

| No. | C | Si | Mn | P | S | Cr | Mo | V | Nb | B | Ni |
|---|---|---|---|---|---|---|---|---|---|---|---|
| C1 | 3.6 | 0.8 | 0.3 | 0.02 | 0.01 | 1.7 | 3.8 | 3.1 | 0.7 | 0.003 | — |
| C2 | 3.0 | 2.9 | 0.7 | 0.02 | 0.01 | 0.6 | 0.8 | 4.1 | 2.1 | 0.009 | — |
| C3 | 2.6 | 1.3 | 0.4 | 0.03 | 0.01 | 0.7 | 1.4 | 3.3 | 0.9 | 0.021 | — |
| C4 | 3.5 | 0.9 | 0.2 | 0.02 | 0.01 | 1.5 | 1.9 | 7.2 | 3.2 | 0.080 | — |
| C5 | 4.4 | 1.3 | 0.9 | 0.03 | 0.01 | 0.8 | 3.1 | 4.8 | 2.1 | 0.050 | — |
| C6 | 4.1 | 2.2 | 0.9 | 0.03 | 0.01 | 1.4 | 1.8 | 5.0 | 1.5 | 0.092 | — |
| C7 | 3.8 | 1.3 | 0.4 | 0.02 | 0.01 | 0.7 | 1.9 | 5.1 | 1.2 | 0.008 | — |
| C8 | 3.9 | 1.5 | 0.3 | 0.02 | 0.01 | 0.9 | 1.8 | 3.8 | 2.9 | 0.031 | — |
| C9 | 4.6 | 1.6 | 0.2 | 0.02 | 0.01 | 0.5 | 1.0 | 3.0 | 1.1 | 0.015 | — |
| C10 | 3.2 | 1.2 | 1.9 | 0.03 | 0.01 | 0.6 | 1.2 | 5.0 | 3.9 | 0.077 | — |
| C11 | 2.9 | 1.2 | 0.4 | 0.03 | 0.01 | 0.8 | 2.5 | 3.6 | 1.5 | 0.011 | 1.3 |
| C12 | 3.2 | 1.6 | 0.3 | 0.03 | 0.01 | 1.1 | 2.2 | 4.8 | 2.0 | 0.056 | 4.6 |
| D1 | 2.4 | 1.1 | 0.3 | 0.02 | 0.01 | 1.6 | 1.8 | 5.0 | 1.9 | 0.005 | — |
| D2 | 4.9 | 0.9 | 0.3 | 0.03 | 0.01 | 0.8 | 1.9 | 3.5 | 2.3 | 0.023 | — |
| D3 | 4.0 | 0.3 | 0.3 | 0.03 | 0.01 | 0.9 | 2.5 | 5.5 | 1.2 | 0.048 | — |
| D4 | 3.3 | 3.4 | 0.5 | 0.02 | 0.01 | 1.5 | 0.9 | 5.0 | 1.6 | 0.089 | — |
| D5 | 3.9 | 0.9 | 2.3 | 0.03 | 0.01 | 0.8 | 1.1 | 4.5 | 2.1 | 0.013 | — |
| D6 | 4.1 | 1.0 | 0.4 | 0.02 | 0.01 | 0.2 | 1.8 | 6.0 | 3.1 | 0.032 | — |
| D7 | 3.9 | 1.5 | 0.3 | 0.02 | 0.01 | 2.2 | 2.6 | 4.9 | 2.2 | 0.055 | — |
| D8 | 4.1 | 0.9 | 0.3 | 0.03 | 0.01 | 1.4 | 5.5 | 4.2 | 1.2 | 0.007 | — |
| D9 | 3.9 | 0.9 | 0.5 | 0.02 | 0.01 | 0.7 | 1.4 | 2.4 | 1.2 | 0.009 | — |
| D10 | 4.4 | 1.2 | 0.3 | 0.02 | 0.01 | 0.8 | 1.3 | 10.6 | 2.8 | 0.062 | — |
| D11 | 3.7 | 1.1 | 0.4 | 0.02 | 0.01 | 0.8 | 1.0 | 3.5 | 0.5 | 0.025 | — |
| D12 | 3.6 | 0.9 | 0.5 | 0.03 | 0.01 | 1.6 | 1.1 | 5.1 | 1.6 | 0.006 | — |
| D13 | 3.9 | 1.6 | 0.7 | 0.03 | 0.01 | 0.8 | 1.6 | 4.6 | 5.0 | 0.014 | — |
| D14 | 4.0 | 0.9 | 0.3 | 0.02 | 0.01 | 0.8 | 1.9 | 3.2 | 1.2 | — | — |
| D15 | 3.8 | 2.2 | 0.4 | 0.03 | 0.01 | 1.1 | 3.2 | 6.2 | 2.5 | 0.120 | — |

V: 3.0 to 10.0% and Nb: 0.6 to 7.0%, satisfying the following formulae 1), (2), (3) and (4):

$$2.0+0.15\,V+0.10\,Nb \leqq C\ (\%) \quad (1)$$

$$1.1 \leqq Mo/Cr \quad (2)$$

$$Nb/V \leqq 0.8 \quad (3)$$

$$0.2 \leqq Nb/V \quad (4)$$

the remainder being Fe and inevitable impurities, said material having been produced by casting as a melt with a pouring temperature at 1,400° C. or higher.

2. A centrifugal cast roll shell material comprising a granular MC type carbide, graphite and C: 2.5 to 4.7%, Si: 0.8 to 3.2%, Mn: 0.1 to 2.0%, Cr: 0.4 to 1.9%, Mo: 0.6 to 5%, V: 3.0 to 10.0% and Nb: 0.6 to 7.0% and B: 0.002 to 0.1%, satisfying the following formulae (1), (2), (3) and (4):

$$2.0+0.15\,V+0.10\,Nb \leqq C\ (\%) \quad (1)$$

$$1.1 \leqq Mo/Cr \quad (2)$$

$$Nb/V \leqq 0.8 \quad (3)$$

$$0.2 \leqq Nb/V \quad (4),$$

the remainder being Fe and inevitable impurities, said material having been produced by casting as a melt with a pouring temperature at 1,400° C. or higher.

TABLE 5

| | | | | Wear Resistance Test | | | | | Rolling Test | | Thermal Shock Test |
|---|---|---|---|---|---|---|---|---|---|---|---|
| | 2.0 + 0.15 V + | | | | Area Ratio | Amount of Wear (g) | | Friction | Surface Observation | | Maximum Depth of Crack Due to |
| No. | 0.10 Nb—C (%) | Mo/Cr | Nb/V | Hardness Hs | of Graphite (%) | Outer Layer | Inner Layer | Coefficient (–) | Scratch Mark | Introduction of Scale | Thermal Shock (mm) |
| C1 | –1.07 | 2.24 | 0.23 | 80 | 1.6 | 0.13 | 0.14 | 0.261 | Not Detected | Not Detected | 0.1 |
| C2 | –0.18 | 1.33 | 0.53 | 80 | 0.9 | 0.14 | 0.12 | 0.271 | Not Detected | Not Detected | 0.3 |
| C3 | –0.02 | 1.99 | 0.27 | 81 | 0.3 | 0.14 | 0.15 | 0.271 | Not Detected | Not Detected | 0.2 |
| C4 | –0.11 | 1.25 | 0.44 | 82 | 0.2 | 0.14 | 0.15 | 0.270 | Not Detected | Not Detected | 0.2 |
| C5 | –1.47 | 3.99 | 0.44 | 80 | 2.4 | 0.12 | 0.13 | 0.267 | Not Detected | Not Detected | 0.1 |
| C6 | –1.19 | 1.27 | 0.31 | 79 | 2.1 | 0.14 | 0.15 | 0.274 | Not Detected | Not Detected | 0.4 |
| C7 | –0.92 | 2.66 | 0.23 | 80 | 1.6 | 0.14 | 0.13 | 0.265 | Not Detected | Not Detected | 0.2 |
| C8 | –1.04 | 2.11 | 0.75 | 81 | 1.8 | 0.15 | 0.13 | 0.262 | Not Detected | Not Detected | 0.1 |
| C9 | –2.04 | 2.15 | 0.35 | 79 | 3.4 | 0.12 | 0.11 | 0.269 | Not Detected | Not Detected | 0.2 |
| C10 | –0.05 | 2.02 | 0.77 | 82 | 0.3 | 0.13 | 0.11 | 0.264 | Not Detected | Not Detected | 0.2 |
| C11 | –0.21 | 3.13 | 0.43 | 81 | 0.5 | 0.13 | 0.12 | 0.272 | Not Detected | Not Detected | 0.2 |
| C12 | –0.28 | 2.00 | 0.41 | 82 | 0.7 | 0.13 | 0.11 | 0.269 | Not Detected | Not Detected | 0.1 |
| D1 | 0.54 | 1.13 | 0.38 | 82 | 0.0 | 0.13 | 0.12 | 0.383 | Not Detected | Not Detected | 0.2 |
| D2 | –2.15 | 2.38 | 0.66 | 80 | 5.6 | 0.78 | 0.65 | 0.272 | Not Detected | Not Detected | 0.4 |
| D3 | –1.06 | 2.78 | 0.22 | 81 | 0.0 | 0.13 | 0.14 | 0.369 | Not Detected | Not Detected | 0.3 |
| D4 | –0.39 | 0.60 | 0.32 | 80 | 8.0 | 1.44 | 1.42 | 0.270 | Detected | Not Detected | 0.3 |
| D5 | –1.02 | 1.38 | 0.47 | 81 | 1.7 | 0.14 | 0.16 | 0.271 | Detected | Detected | 2.9 |
| D6 | –0.89 | 9.00 | 0.52 | 80 | 1.6 | 0.88 | 0.85 | 0.267 | Not Detected | Not Detected | 3.3 |
| D7 | –0.95 | 1.18 | 0.45 | 82 | 0.0 | 0.14 | 0.16 | 0.402 | Not Detected | Not Detected | 0.5 |
| D8 | –1.35 | 3.93 | 0.29 | 81 | 2.1 | 0.14 | 0.14 | 0.271 | Not Detected | Not Detected | 3.4 |
| D9 | –1.42 | 2.00 | 0.50 | 80 | 2.3 | 0.99 | 1.07 | 0.267 | Not Detected | Not Detected | 1.0 |
| D10 | –0.53 | 1.63 | 0.26 | 79 | 1.0 | 0.13 | 0.12 | 0.277 | Not Detected | Not Detected | 2.0 |
| D11 | –1.13 | 1.25 | 0.14 | 81 | 1.9 | 1.23 | 0.12 | 0.272 | Not Detected | Not Detected | 0.2 |
| D12 | –0.68 | 0.69 | 0.31 | 81 | 1.0 | 0.14 | 0.14 | 0.269 | Detected | Detected | 0.3 |
| D13 | –0.71 | 2.00 | 1.09 | 81 | 1.4 | 0.15 | 0.13 | 0.276 | Not Detected | Not Detected | 2.6 |
| D14 | –1.40 | 2.38 | 0.38 | 82 | 2.3 | 0.20 | 0.21 | 0.282 | Not Detected | Not Detected | 0.3 |
| D15 | –0.62 | 2.91 | 0.40 | 82 | 1.3 | 0.21 | 0.20 | 0.273 | Not Detected | Not Detected | 2.8 |

What is claimed is:

1. A centrifugal cast roll shell material comprising a granular MC type carbide, graphite and C: 2.5 to 4.7%, Si: 0.8 to 3.2% Mn: 0.1 to 2.0%, Cr: 0.4 to 19% Mo: 0.6 to 5%

3. A centrifugal cast roll shell material according to claim 1 further comprising Ni: 5.5% or less.

4. A centrifugal cast roll shell material according to claim 2 further comprising Ni:5.5% or less.

* * * * *

UNITED STATES PATENT AND TRADEMARK OFFICE

CERTIFICATE OF CORRECTION

PATENT NO. : 5,738,734

DATED : April 14, 1998

INVENTOR(S) : Yoshitaka SAWA; Tomoya KOSEKI; Kenji ICHINO

It is certified that error appears in the above-indentified patent and that said Letters Patent is hereby corrected as shown below:

Claim 1, line 3, change "Cr: 0.4 to 19%" to --Cr: 0.4 to 1.9%--.

Signed and Sealed this

Twenty-fourth Day of November, 1998

*Attest:*

Bruce Lehman

BRUCE LEHMAN

*Attesting Officer*

*Commissioner of Patents and Trademarks*